US008424334B2

(12) United States Patent
Kang et al.

(10) Patent No.: US 8,424,334 B2
(45) Date of Patent: Apr. 23, 2013

(54) ICE MAKING APPARATUS FOR REFRIGERATOR

(75) Inventors: Byeong-Gyu Kang, Gyeongsangnam-Do (KR); Jae-Youl Lee, Gyeongsangnam-Do (KR); Sang-Ho Park, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 397 days.

(21) Appl. No.: 12/746,199

(22) PCT Filed: Dec. 2, 2008

(86) PCT No.: PCT/KR2008/007114

§ 371 (c)(1),
(2), (4) Date: Jun. 4, 2010

(87) PCT Pub. No.: WO2009/072794

PCT Pub. Date: Jun. 11, 2009

(65) Prior Publication Data

US 2010/0257888 A1 Oct. 14, 2010

(30) Foreign Application Priority Data

Dec. 5, 2007 (KR) ..... 10-2007-0125803

(51) Int. Cl.
*F25C 1/22* (2006.01)

(52) U.S. Cl.
USPC ..... 62/340; 62/344; 62/348

(58) Field of Classification Search ..... 62/340, 62/344, 348, 353, 135, 137, 139
See application file for complete search history.

(56) References Cited

U.S. PATENT DOCUMENTS

| | | | | |
|---|---|---|---|---|
| 4,815,691 | A | 3/1989 | Cooley | |
| 5,970,725 | A * | 10/1999 | Lee | 62/137 |
| 6,058,720 | A * | 5/2000 | Ryu | 62/135 |
| 6,148,620 | A * | 11/2000 | Kumagai et al. | 62/72 |
| 6,735,974 | B2 * | 5/2004 | Oh | 62/347 |
| 7,134,292 | B2 * | 11/2006 | Oh | 62/137 |
| 2004/0194480 | A1 * | 10/2004 | Kim et al. | 62/135 |
| 2005/0072167 | A1 * | 4/2005 | Oh | 62/137 |
| 2006/0131324 | A1 * | 6/2006 | Noh et al. | 221/150 R |
| 2007/0209381 | A1 * | 9/2007 | Sugaya et al. | 62/340 |
| 2007/0220909 | A1 * | 9/2007 | An et al. | 62/137 |
| 2008/0163639 | A1 * | 7/2008 | Hwang | 62/344 |

FOREIGN PATENT DOCUMENTS

| | | | |
|---|---|---|---|
| CN | 1993589 | A | 7/2007 |
| JP | 09-324970 | A | 12/1997 |
| JP | 2006-38331 | A * | 2/2006 |
| KR | 10-2000027232 | A | 5/2000 |
| KR | 10-2005033295 | A | 4/2005 |
| KR | 728361 | B1 | 6/2007 |
| WO | WO2005026631 | A1 | 3/2005 |

OTHER PUBLICATIONS

Abstract of JP 2006-38331A to Ueno et al.*
Translation of JP 2006-38331 A to Ueno et al.*

(Continued)

*Primary Examiner* — Mohammad Ali
(74) *Attorney, Agent, or Firm* — Fish & Richardson P.C.

(57) ABSTRACT

Disclosed is an ice making apparatus for a refrigerator, the apparatus comprising a frame having an accommodating space therein, and at least an ice tray detachably installed in the frame and configured to provide a space for containing water to make ice, whereby the ice making apparatus can be easily cleaned up and ice can be easily handled.

19 Claims, 4 Drawing Sheets

OTHER PUBLICATIONS

Chinese Office Action dated Mar. 23, 2011 for Application No. 200880119125.9, in English, 8 pages.

Korean Notice of Allowance issued in Application No. 10-2007-0125803, mailed Oct. 27, 2009, 2 pages.

International Search Report dated Jun. 24, 2009 for Application No. PCT/KR2008/007114, 2 pages.

* cited by examiner

ICE MAKING APPARATUS FOR REFRIGERATOR

TECHNICAL FIELD

The present invention relates to an ice making apparatus for a refrigerator, and particularly, to an ice making apparatus for a refrigerator capable of facilitating a cleaning.

BACKGROUND ART

In general, a refrigerator is a device including a refrigerator main body having at least a cooling chamber, a door for opening/closing the cooling chamber, and a refrigerating cycle for supplying cold air to the cooling chamber, thus to store foods in a state of low temperature.

Such refrigerator is further provided with an ice maker as an apparatus for generating ice, and an ice bank in which the ice generated by the ice maker is stored.

In recent time, as a demand increases, ice makers and ice banks are widely installed in the refrigerators. Ice made by the ice maker is dropped in the ice bank to be collected therein.

When a usage time limit of the ice maker expires, foreign materials or the like may be settled in the ice maker, and accordingly the ice maker is needed to be cleaned up.

However, the related art ice maker is not facilitated to be assembled or disassembled, and thereby the ice maker is partially cleaned with being still installed in the refrigerator, which causes unsanitary condition thereof. If both inside and outside of the ice maker are desired to be cleaned up, then the ice maker is disassembled from the refrigerator main body or the door for the cleaning, resulting in a complicated operation. Also, after the cleaning, the ice maker should be reassembled and then coupled back to the refrigerator main body or the door, requiring considerable time and effort for the cleaning of the ice maker.

In particular, in the related art ice maker, an ice tray containing water to form ice is fixed to a frame of the ice maker. It is thusly not easy to separate the ice tray from the frame. Accordingly, the cleaning of the ice tray is also complicated and the inside of the frame is unapproachable, thereby interfering with the cleaning of the inside of the frame.

DISCLOSURE OF INVENTION

Technical Problem

Therefore, an object of the present invention is to provide an ice making apparatus for a refrigerator capable of facilitating disassembly and assembly of ice trays.

Another object of the present invention is to provide an ice making apparatus for a refrigerator capable of being approachable to each portion of the ice making apparatus and thusly facilitating a cleaning thereof.

Technical Solution

To achieve these and other advantages and in accordance with the purpose of the present invention, as embodied and broadly described herein, there is provided an ice making apparatus for a refrigerator comprising: a frame having an accommodating space therein; and at least an ice tray detachably installed in the frame and configured to provide spaces for containing water to make ice.

Here, the apparatus may further comprise a connection unit configured to allow the ice tray to be rotated and attached/detached with respect to the frame.

The apparatus may further comprise a tray rotating unit configured to rotate the ice tray from an ice making position where ice is created to an ice separating position where ice is separated.

The tray rotating unit may comprise a lever rotatably disposed at the frame, and a power transfer unit configured to transfer a rotational force of the lever to the ice tray.

The connection unit may comprise engaging portions configured such that a rotational shaft of the lever is engaged with the ice tray.

The tray rotating unit further may comprise an elastic member configured to apply an elastic force to the lever so as to return to an initial position thereof.

The elastic member is connected to the rotational shaft of the lever.

Each of the engaging portions comprises a protrusion formed at the rotational shaft of the lever, and a protrusion receiving portion configured at one side of the ice tray to receive the protrusion therein.

The protrusion receiving portion has one end open such that the corresponding ice tray is horizontally inserted therein.

The protrusion receiving portion is disposed at a lower side of the open area when the ice tray is rotated to the ice separating position.

The connection unit may comprise pins protruded from one side of the ice tray, and a guide slot configured to guide the pin.

The guide slot is arcuately formed at the frame to correspond to a rotating track of the pin.

The connection unit comprises a guide unit configured to guide the protrusion to be engaged with the protrusion receiving portion when coupling the ice tray to the frame.

Each of the ice trays has an inclined surface at a portion facing the guide unit.

In accordance with another aspect of the present invention, there is provided an ice making apparatus for a refrigerator comprising: a frame having an accommodating space with one side open; a door coupled to the frame and configured to open/close the accommodating space; and at least ice tray detachably disposed in the frame and configured to provide a space for containing water to make ice.

Here, the apparatus may further comprise a tray rotating unit having a lever rotatably coupled to the frame.

The lever interferes with the door when opening the door so as to be restricted from being rotated.

At least one of the door and the frame is provided with at least a magnet configured to increase a coupling force between the door and the frame. Here, another one of the door and the frame may be provided with a magnet or magnetic substance corresponding to the magnet.

The apparatus may further comprise a connection unit configured to allow the ice tray to be rotated and attached/detached with respect to the frame.

The foregoing and other objects, features, aspects and advantages of the present invention will become more apparent from the following detailed description of the present invention when taken in conjunction with the accompanying drawings.

Advantageous Effects

As mentioned so far, the present invention can be implemented to easily attach or detach ice trays with respect to the frame so as to facilitate the cleaning of the ice trays and the frame.

Also, the present invention can be implemented to separate the ice trays from the frame to allow the separation of ice created in the ice trays at the outside of the ice maker, thereby improving user's convenience.

The present invention can employ a tray rotating unit for rotating the ice trays so as to facilitate the separation ice from the ice trays. In particular, an elastic member for restoring a lever to its initial position is further provided to much facilitate the operation of separating ice from the ice trays. The elastic member is also connected to a rotational shaft of the lever, and thus only one elastic member can restore the lever and the ice trays to their initial positions, thereby enabling a simplified configuration and an effective restoration of the lever and the ice trays to their initial positions.

The present invention can further employ a door for opening/closing an open area of the frame, so as to facilitate attachment and detachment of the ice trays and also the cleaning of an inner space of the frame due to an easy approach. In addition, the door is configured to close the inner space of the frame, thus to prevent an introduction of external foreign materials into the interior.

MODE FOR THE INVENTION

Reference will now be made in detail to embodiments of the present disclosure, examples of which are illustrated in the accompanying drawings.

Figure 1:
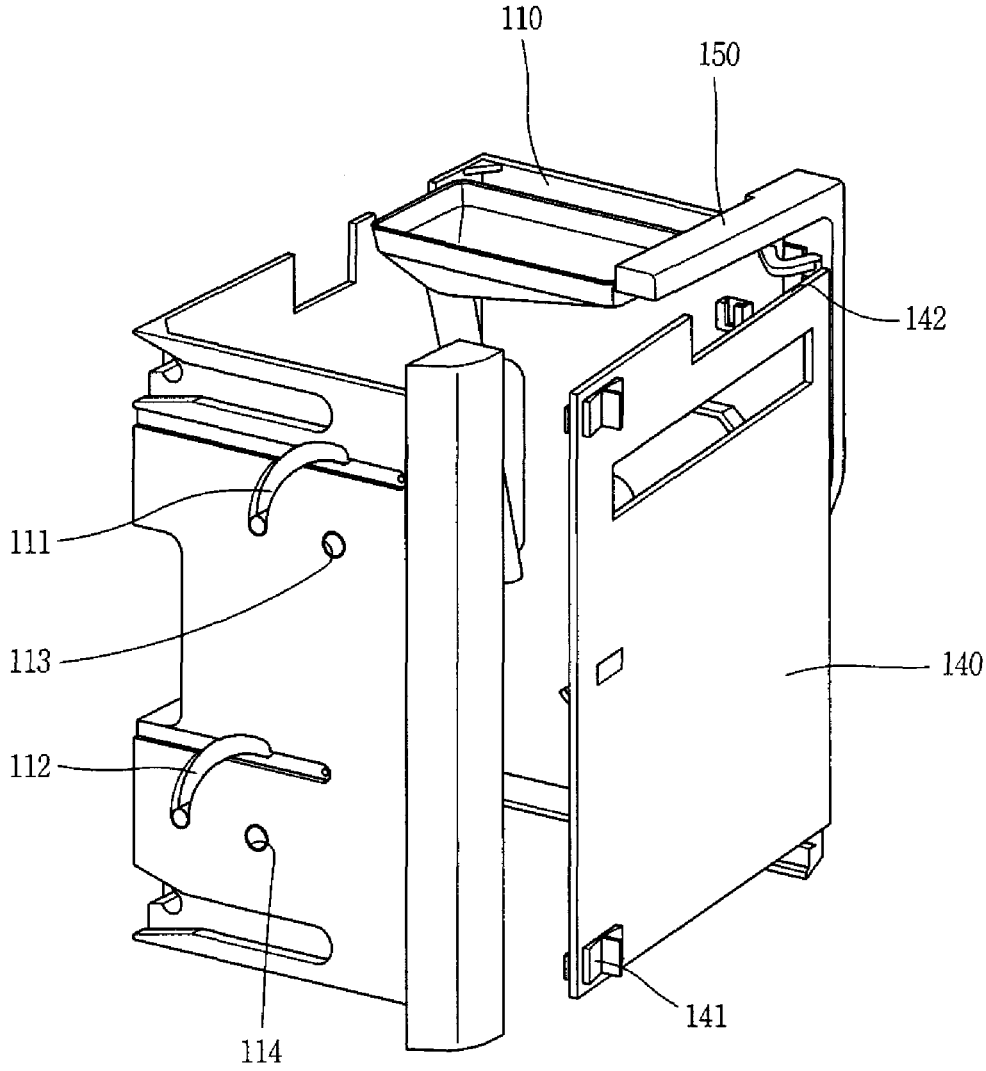
FIG. 1 is a perspective view showing an ice making apparatus for a refrigerator in accordance with one embodiment of the present invention.
Figure 2:
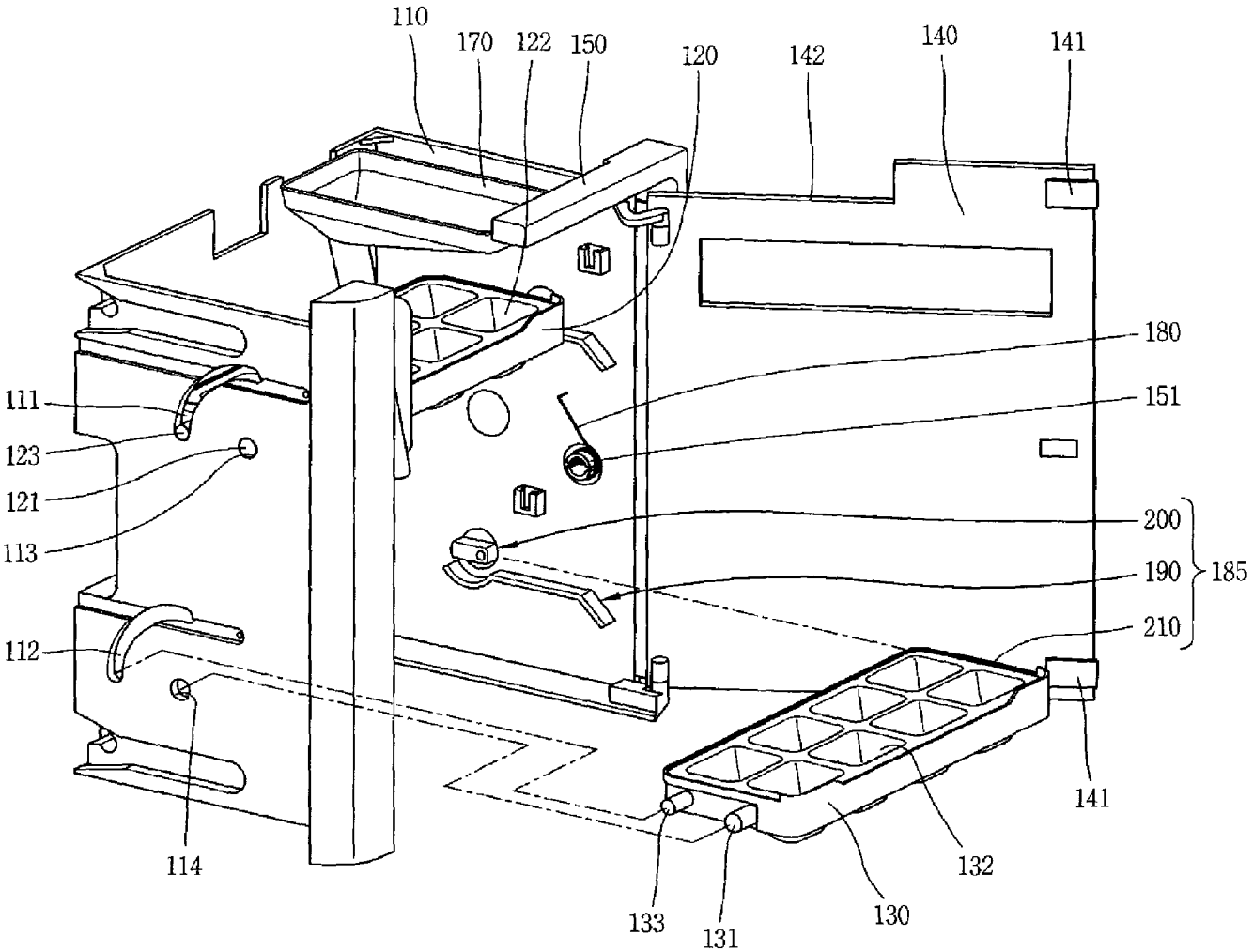
FIG. 2 is a perspective view showing a process of separating an ice tray of the ice making apparatus shown in FIG. 1.

As shown in FIGS. 1 and 2, an ice making apparatus ford a refrigerator may include a frame 110 configuring an accommodating space therein, and ice trays detachably coupled to the frame 110. Here, the frame 110 may be coupled to the inside of the refrigerator, namely, to a refrigerator main body or a refrigerator door. Also, the number of ice trays may appropriately be adjusted. Hereinafter, description will be given of an example in which an upper tray 120 and a lower tray 130 are disposed at an upper side and a lower side in the frame 110.

The frame 110 implements a framework of the ice making apparatus of the refrigerator, and has the accommodating space therein.

A water supply unit 170 may be provided at an upper portion in the frame 110 for supplying water to the lower tray 130. The water supply unit 170 may be formed in a shape of a funnel. Here, the water supply unit 170 and the upper tray 120 may be supplied with water by a water supply container (not shown).

The upper and lower trays 120 and 130 are detachably installed in the frame 110. They are components in which water to become ice is contained. A plurality of cells 122 and 132 for forming certain shapes of ice are partitioned in the upper tray 120 and the lower tray 130, respectively.

Rotational shafts 121 and 131 are formed through each one end portion of the upper tray 120 and the lower tray 130. Guide pins 123 and 133 are protruded from one side of each of the upper and lower trays 120 and 130 to be in parallel with the rotational shafts 121 and 131.

Corresponding to those components, rotational shaft holes 113 and 114 in which the rotational shafts 121 and 131 are detachably inserted are formed through one surface of the frame 110. Guide slots 111 and 112 for guiding the guide pins 123 and 133 are formed at one side of the rotational shaft holes 113 and 114. Each of the guide slots 111 and 113 is formed in an arcuate shape curved by a certain curvature so as to correspond to a rotating track of each guide pin 123 and 133. This one embodiment is implemented such that the guide slots 111 and 112 are formed through the frame 110.

Under the state that the guide pins 123 and 133 of the upper tray 120 and the lower tray 130 are inserted respectively in the upper guide slot 111 and the lower guide slot 112, when the upper tray 120 and the lower tray 130 are rotated, the guide pins 123 and 133 of the upper tray 120 and the lower tray 130 are guided by the upper guide slot 111 and lower guide slot 112 to thusly be moved.

Such upper and lower trays 120 and 130 may be rotated and attached/detached with respect to the frame 110. The detailed configuration that the upper and lower trays 120 and 130 can be rotated and attached/detached from the frame 110 will be described later.

As the upper and lower trays 120 and 130 are rotatable and detachable with respect to the frame 110, the upper and lower trays 120 and 130 are separated from the frame 110 so as to allow ice generated in the upper and lower trays 120 and 130 to be separated at the outside of the ice making apparatus.

In addition, the separated upper and lower trays 120 and 130 can easily be cleaned up outside the frame 110.

Upon the separation of the upper and lower trays 120 and 130, a user can be easily accessible to all the corners in the frame 110, resulting in facilitating the cleaning of the frame 110.

In the meantime, the frame 110 may be provided with a tray rotating unit 149 for rotating the upper and lower trays 120 and 130.

The tray rotating unit 149 may include a lever 150 rotatably coupled to the frame 110, and a power transfer unit 160 for transferring a rotational force of the lever 150 to the upper and lower trays 120 and 130 such that the upper and lower trays 120 and 130 are wrenched to be rotated to an ice separating position at which ice inside the trays 120 and 130 are separated.

The lever 150 is connected to the frame 110 to be rotatable based upon a certain rotational shaft 151. When an external force is applied to one side of the lever 150, the lever 150 rotates centering around the rotational shaft 151. An upper end portion of the lever 150 is bent in a horizontal direction to be easily grasped.

Figure 4:
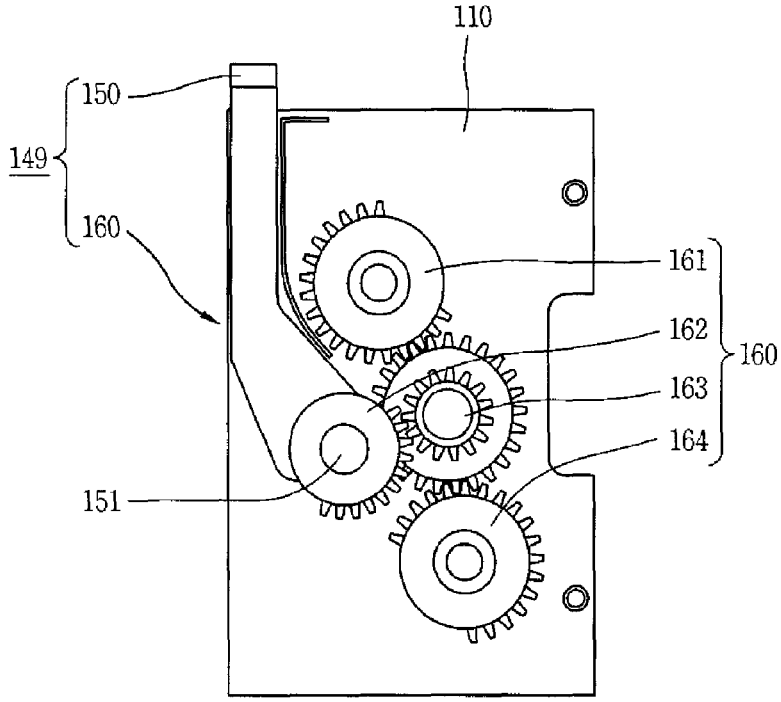
FIG. 4 is a view showing a frame, a lever and a gear of the ice making apparatus shown in FIG. 1.

As shown in FIG. 4, the power transfer unit 160 may include an upper tray gear 161 formed at one side of the upper tray 120, a lower tray gear 164 formed at one side of the lower tray 130, a lever side gear 162 formed at one side of the rotational shaft 151 of the lever 150 and a connection gear 163 engaged with each of the lever side gear 162, the upper tray gear 161 and the lower tray gear 164.

The operation of the power transfer unit 160 having such configuration will now be described.

When the lever 150 is rotated centering around the rotational shaft 151, the lever side gear 162 integrally molded with the lever 150 is then rotated. The connection gear 163 engaged with the lever side gear 162 is accordingly rotated in an opposite direction of the lever side gear 162.

Afterwards, the upper tray gear 161 and the lower tray gear 164 respectively engaged with upper and lower sides of the connection gear 163 are rotated in the same direction to the rotating direction of the lever side gear 162. The upper tray 120 and the lower tray 130 connected respectively to the upper tray gear 161 and the lower tray gear 164 are thusly rotated.

Through such processes, the external force applied to the lever 150 is transferred to the upper and lower trays 120 and 130, to make the upper and lower trays 120 and 130 rotated.

Meanwhile, engaging portions may be formed at one area of one side of each ice tray such that the ice tray can be engaged with the lever 150 to be rotatable when the lever is rotated. Each of the engaging portions may include a frame side engaging portion 200 and an ice tray side engaging portion 210 formed at the side of the corresponding ice tray.

Figure 5:
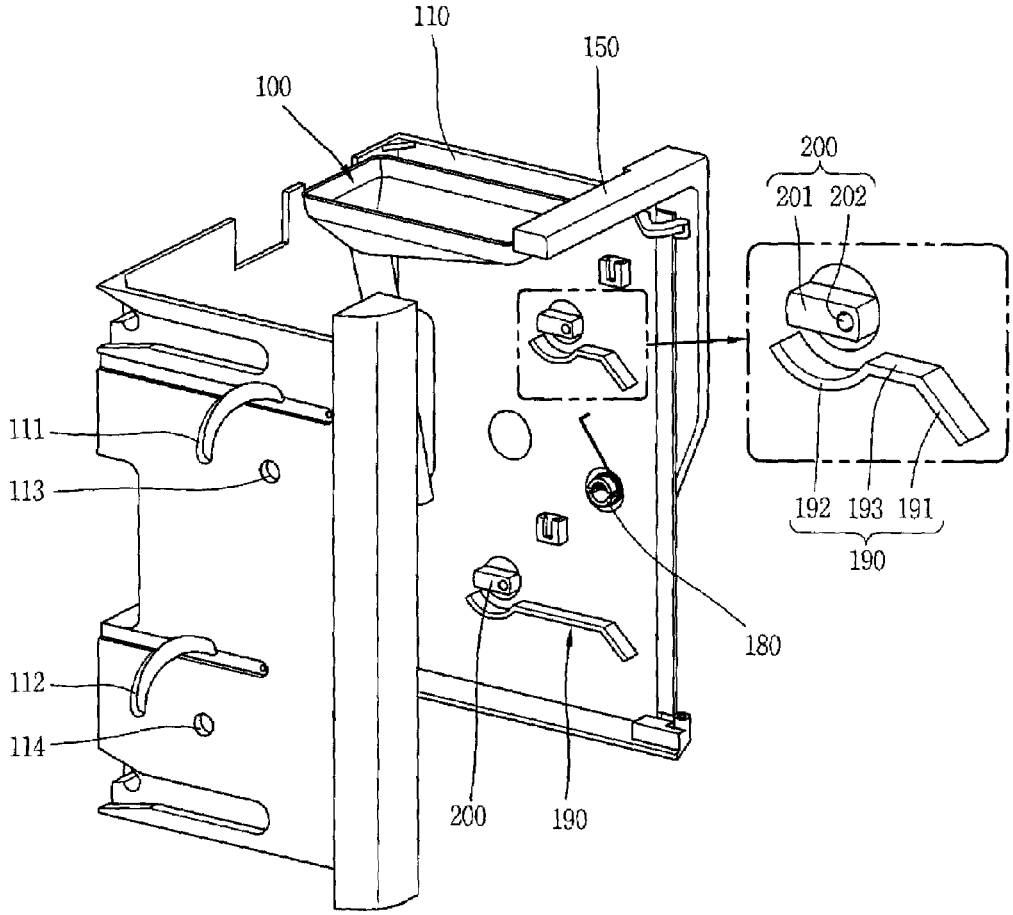
FIG. 5 is a perspective view showing a protrusion and a guide unit of the ice making apparatus shown in FIGS. 1.

The frame side engaging portion 200, as shown in FIG. 5, is formed at each rotational shaft of the upper and lower tray gears 161 and 164 so as to be in cooperation with the rotation of the lever 150. Each frame side engaging portion 200 includes a protrusion 201 protruded from an inner surface of the frame 110 to have a long length in a horizontal direction. Each protrusion 201 has a groove 202 recessed in an axial direction of the rotational shaft.

Figure 6:
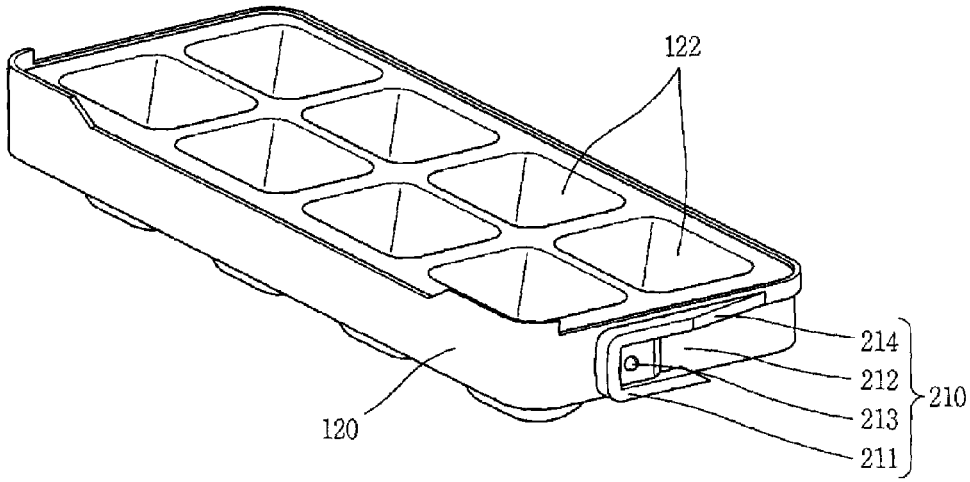
FIG. 6 is a perspective view showing a protrusion receiving portion of the ice making apparatus shown in FIG. 1.

The ice tray side engaging portion 210, as shown in FIG. 6, may include a protrusion receiving portion 211 for receiving the protrusion 201 therein, an open hole 212 formed at one side of the protrusion receiving portion 211 such that the protrusion 201 can be inserted therein in a horizontal direction, a stopper 213 formed in the protrusion receiving portion 211, and an inclined surface 214 formed at one side of the protrusion receiving portion 211.

The protrusion receiving portion 211 is formed in a protruded shape excluding the direction of the open hole 212.

The open hole 212 is rotated downwardly in cooperation with the rotation of the upper and lower trays 120 and 130.

The stopper 213 is protruded inside the protrusion receiving portion 211. The stopper 213 is formed in a proper shape to be engaged with the groove 202, thus to prevent the ice tray side engaging portion 210 from being unexpectedly separated from the frame side engaging portion 200 to the open hole 212.

The inclined surface 214 can be formed at at least one end of the protrusion receiving portion 211.

When the upper and lower trays 120 and 130 are coupled to the frame 110, the protrusion 201 is inserted through the open hole 212 to be received in the protrusion receiving portion 211. At this time, the stopper 213 is engaged with the groove 202. Accordingly, the protrusion 201 can be prevented from being unexpectedly separated toward the open hole 212.

After being coupled, each one side of the upper and lower trays 120 and 130 is engaged with the rotational shaft 151, thus to be rotated in cooperation with the rotation of the lever 150.

Here, each another side of the upper and lower trays 120 and 130 are rotated with being inserted respectively in the upper and lower guide slots 111 and 112 formed at the frame 110 and each rotational shaft hole 113 and 114.

Each lower side of the frame side engaging portions 200 may be provided with a guide unit 190 for guiding the protrusion 201 of each of the upper and lower trays 120 and 130 upon the insertion thereof.

The guide unit 190 may include a guiding surface 191 inclined such that its starting part faces a lower side, a horizontal guiding surface 193 extending from the guiding surface 191 by a certain length in a horizontal direction, and a receiving surface 192 connected to one side of the horizontal guiding surface 193 and downwardly curved with a certain curvature. Here, the horizontal guiding surface of a lower guide unit 190 for guiding the lower tray 130 is formed longer than the horizontal guiding surface 193 of the guide unit 190 for guiding the upper tray 120.

The guide unit 190 guides the upper and lower trays 120 and 130 toward the protrusion 201 when the upper and lower trays 120 and 130 are coupled to the frame 110.

In more detail, when the upper and lower trays 120 and 130 are coupled to the frame 110, the ice tray side engaging portion 210 is first approached to the guide unit 190.

The ice tray side engaging portion 210 having approached is then guided along the guiding surface 191 of the guide unit 190 to be positioned at the horizontal guiding surface 193. Accordingly, the open hole 212 is height-adjusted to be disposed at one side of the protrusion 201. When the protrusion receiving portion 211 is moved along the horizontal guiding surface 193, the protrusion 201 is inserted in the protrusion receiving portion 211 via the open hole 212. At this time, the stopper 213 is engaged with the groove 202 so as to prevent the protrusion 201 from being separated from the protrusion receiving portion 211. Here, when the upper or lower tray 120 or 130 is rotated in cooperation with the rotation of the lever 150, the lower area of the protrusion receiving portion 211 is rotated along the receiving surface 192.

Figure 3:
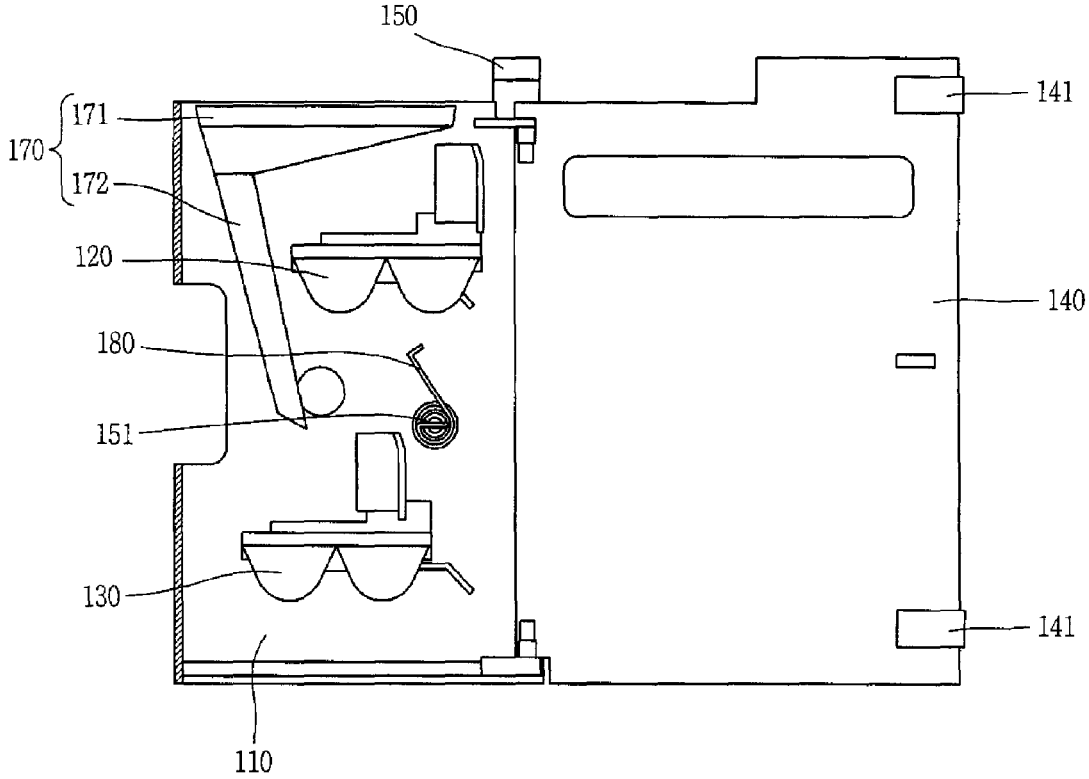
FIG. 3 is a longitudinal cross-sectional view showing an open state of a door of the ice making apparatus shown in FIG. 1.

In the meantime, the water supply unit 170, as shown in FIGS. 2 and 3, may include an extending portion 171 having an inclined bottom surface, and an inducing portion 172 extending downwardly from the bottom surface of the extending portion 171.

The water supply unit 170 is a part which receives water in the extending portion 171 and supplies the received water to the lower tray 130 via the inducing portion 172.

The lever 150 may be provided with an elastic member 180 having an elastic force for returning the lever 150 to its initial position after the lever 150 rotates the ice trays to the ice separating position. The elastic member 180 may be implemented as a spring member. Also, the elastic member 180 may be connected to the rotational shaft 151 of the lever 150. Here, the elastic member 180 may be implemented as a torsion coil spring to be connected to the rotational shaft 151.

With such configuration, the restoring force of the elastic member 180 may be applied to the upper and lower trays 120 and 130 via the power transfer unit 160 as well as to the lever 150. Hence, employing a singular elastic member 180 can allow all of the lever 150, the upper tray 120 and the lower tray 130 to be restored to their initial positions. Thus, the structure for applying the restoring force can be simplified.

Here, the frame side engaging portion 200, the ice tray side engaging portion 210 and the guide unit 190 cooperate together such that the upper and lower trays 120 and 130 can be rotated and attached/detached with respect to the frame 110. From this perspective, they may be defined as a connection unit 185.

An open area may be formed at one side, namely, a front surface of the frame 110. A door 140 for opening/closing the accommodating space may be disposed at the front surface of the frame 110, which allows an easy approach to the inner space of the frame 110 and also facilitates the attachment/detachment of ice trays, namely, the upper and lower trays 120 and 130. In addition, when detaching the upper and lower trays 120 and 130 from the frame 110, each area of the inner space of the frame 110 can be much facilitated to be approached. The door 140 may rotatably be coupled to the front surface of the frame 110.

The door 140 may cover the open area of the frame 110, and rotatably coupled to one side of the open area of the frame 110 by a hinge.

When the door 140 with such structure is rotated to open the open area of the frame 110, the open area of the frame 110 allows the upper and lower trays 120 and 130 to be attached or detached.

When the door 140 is rotated to close the open area of the frame 110, it can be allowed to prevent the introduction of external foreign materials in the frame 110, particularly, the upper and lower trays 120 and 130.

A lever rotation preventing portion 142 may be formed at one area of an upper side of the door 140. Accordingly, when the door 140 is open, the lever rotation preventing portion 142 comes in contact with the lever 150 to prevent the downward rotation of the lever 150. The lever rotation preventing portion 142 may be formed by partially cutting off an upper end at the side of the lever 150. When the door 140 is open, the lever 150 interferes with the lever rotation preventing portion 142 so as to be restricted from being rotated. Hence, when the door is open and the ice trays 120 and 130 are drawn out, even if an external force is unexpectedly applied to the lever 150, the rotation of the lever 150 is restricted by the lever rotation preventing portion 142 of the door 140, thereby preventing the ice trays 120 and 130 from being turned over.

The door 140 may further be provided with magnets 141. Another magnets or magnetic substances to be coupled to the magnets 141 by a magnetic force may be provided at the frame 110. Accordingly, the door 140 can much strongly be coupled to the frame 110, thus to firmly maintain a closed state of the door 140 at the frame 110.

Here, the door 140 has been described having the magnets 141 but it is merely exemplary. Such magnets may be disposed on the frame 110 and the magnetic substances such as steel may be installed at the door 140.

As described above, the preferred embodiments of the present invention have been described. However, the present invention may be implemented in various embodiments within the scope of its basic characteristic, and thus such preferred embodiments may not be limited by the detailed description thereof. Also, although not described in detail in the detailed description, the present invention should be widely construed within the scope defined by the appending claims. Variations and modifications included in the technical ground of the claims and the equivalent scope can be covered by the claims.

The invention claimed is:

1. An ice making apparatus for a refrigerator comprising:

a frame having an accommodating space therein defined by at least two side walls;

an ice tray detachably installed in the accommodating space of the frame and having a rotational shaft at a first end thereof;

a connection unit configured to allow a second end of the ice tray to be detachably coupled to the frame;

a lever coupled to the connection unit to be rotatable with respect to the frame;

a guide pin protruded from the ice tray at one side of the rotational shaft of the ice tray; and a guide slot located at the frame to guide the guide pin, wherein the ice tray is attached to or detached from the accommodating space of the frame in a perpendicular direction with respect to the rotation shaft.

2. The apparatus of claim 1, wherein the frame comprises a guide unit to guide the ice tray to enter the accommodating space of the frame.

3. The apparatus of claim 2, wherein the guide unit comprises a guiding surface inclined such that its starting part faces a lower side, and a horizontal guiding surface extending from the guiding surface by a certain length in a horizontal direction.

4. The apparatus of claim 3, wherein the guide unit further comprises a receiving surface connected to one side of the horizontal guiding surface and downwardly curved with a certain curvature.

5. The apparatus of claim 1, further comprising an elastic member having an elastic force for returning the lever to an initial position thereof.

6. The apparatus of claim 1, wherein the connection unit comprises a protrusion formed at a rotational shaft of the lever, and a protrusion receiving portion configured at one side of the ice tray to receive the protrusion therein.

7. The apparatus of claim 6, wherein the protrusion receiving portion comprises an open hole formed at one side of the protrusion receiving portion such that the protrusion can be inserted therein in a horizontal direction, and an inclined surface formed at one side of the protrusion receiving portion.

8. The apparatus of claim 7, wherein the protrusion receiving portion comprises a stopper formed therein, and the protrusion has a groove for receiving the stopper.

9. An ice making apparatus for a refrigerator comprising:

a frame having an accommodating space therein defined by at least two side walls; and a plurality of ice trays detachably installed in the accommodating space of the frame in up and down directions, each having a rotational shaft at a first end thereof;

connection units each configured to allow a second end of the corresponding ice tray to be detachably coupled to the frame;

a lever rotatably installed with respect to the frame;

a power transfer unit configured to transfer a rotational force of the lever to the plurality of ice trays;

guide pins each protruded from one of the plurality of ice trays at one side of the rotational shaft of the corresponding ice tray; and guide slots located at the frame to guide the guide pins, respectively, wherein each of the ice trays is attached to or detached from the accommodating space of the frame in a perpendicular direction with respect to the rotation shaft.

10. The apparatus of claim 9, wherein the frame comprises guide units to guide the ice trays, respectively, to enter the accommodating space of the frame.

11. The apparatus of claim 10, wherein each of the guide units comprises a guiding surface inclined such that its starting part faces a lower side, a horizontal guiding surface extending from the guiding surface by a predetermined length in a horizontal direction.

12. The apparatus of claim 11, wherein each of the guide units further comprises a receiving surface connected to one side of the horizontal guiding surface and downwardly curved with a predetermined curvature.

13. The apparatus of claim 9, further comprising an elastic member having an elastic force for returning the lever to an initial position thereof.

14. The apparatus of claim 9, wherein each of the connection units comprises a protrusion formed at a rotational shaft of the lever, and a protrusion receiving portion configured at one side of the corresponding ice tray to receive the protrusion therein.

15. The apparatus of claim 14, wherein the protrusion receiving portion comprises an open hole formed at one side thereof such that the protrusion is inserted therein in a horizontal direction, and an inclined surface formed at one side thereof.

16. The apparatus of claim 15, wherein the protrusion receiving portion comprises a stopper formed therein, and the protrusion has a groove for receiving the stopper therein.

17. The apparatus of claim 9, further comprising a door coupled to the frame and configured to open/close the accommodating space.

18. The apparatus of claim 17, wherein the lever has an upper end portion bent in a horizontal direction to be located at an upper side of the door, and the door comprises a lever rotation preventing portion configured to prevent a downward rotation of the lever.

19. The apparatus of claim 9, wherein the ice trays comprise an upper tray and a lower tray spaced apart from each other in up and down directions, wherein the power transfer unit comprises an upper tray gear formed at one side of the upper tray, a lower tray gear formed at one side of the lower tray, a lever side gear formed at one side of the lever and a connection gear engaged with each of the lever side gear, the upper tray gear and the lower tray gear.

* * * * *